United States Patent [19]

Pfeifer et al.

[11] 4,140,450

[45] Feb. 20, 1979

[54] APPARATUS FOR THE PRODUCTION OF A PRODUCT FROM CHOPPED FIBERS

[75] Inventors: Kenneth D. Pfeifer; Julius C. Brooks, both of Huntingdon, Pa.

[73] Assignee: Owens-Corning Fiberglas Corporation, Toledo, Ohio

[21] Appl. No.: 861,071

[22] Filed: Dec. 15, 1977

Related U.S. Application Data

[62] Division of Ser. No. 648,075, Jan. 12, 1976, Pat. No. 4,070,730.

[51] Int. Cl.[2] ..... B29J 5/00

[52] U.S. Cl. ..... 425/82.1; 19/305

[58] Field of Search ..... 19/144, 148, 0.56, 0.58, 19/0.6, 308; 425/80.1, 81.1; 156/62.2, 62.4; 264/109, 145, 148, 152, 121

[56] References Cited

U.S. PATENT DOCUMENTS

| | | | |
|---|---|---|---|
| 1,786,669 | 12/1930 | Manning | 19/308 X |
| 2,571,335 | 10/1951 | Brown | 19/144 |
| 2,702,261 | 2/1955 | Bacon et al. | 19/148 X |
| 3,170,197 | 2/1965 | Brenner | 19/148 |
| 4,070,730 | 1/1978 | Pfeifer et al. | 19/0.58 |

FOREIGN PATENT DOCUMENTS

| | | | |
|---|---|---|---|
| 2159485 | 6/1973 | Fed. Rep. of Germany | 19/0.6 |

*Primary Examiner*—Dorsey Newton

*Attorney, Agent, or Firm*—Ronald C. Hudgens; Philip R. Cloutier; Kenneth H. Wetmore

[57] ABSTRACT

An improvement in the production of chopped fibers is provided. Long fibers, commonly in the form of roving, are fed through a chopper assembly comprising a cutter wheel having a plurality of outwardly-extending blades and a back-up roll having a soft cylindrical surface which the blade edges contact with the fibers therebetween. The chopped fibers then are directed downwardly through a discharge chute to a distribution chute below the chopper where they are directed by air to a point of application, e.g. being mixed with resin and applied to a surface of a mold or mandrel. The chopped fibers have had a tendency to agglomerate into hunks or balls below the chopper assembly and such tendency has heretofore been substantially reduced by the use of static bars located below the chopper assembly. An air system is now provided for directing air downwardly past the chopper assembly to convey the chopper fibers therefrom through the discharge duct and the distribution chute. This air flow substantially prevents agglomeration of the fibers and eliminates the need for the static bars heretofore employed.

5 Claims, 3 Drawing Figures

APPARATUS FOR THE PRODUCTION OF A PRODUCT FROM CHOPPED FIBERS

This is a division, of application Ser. No. 648,075, filed Jan. 12, 1976 now U.S. Pat. No. 4070730.

This invention relates to an improved air system for conveying chopped fibers from a chopper assembly to a point of application.

Chopped glass fibers are commonly mixed with various resins to produce a wide variety of fiber-reinforced plastic products. The chopped fiber-resin mixture may be used in a mold to form a product or may be applied to a mandrel to make a storage tank, by way of example. To produce the chopped fibers, long glass fibers in the form of roving are usually employed. Several of the rovings are fed to a chopper assembly comprising a cutter wheel or roll having a plurality of outwardly-extending cutting blades thereon which engage a soft cylindrical surface of a back-up roll, known in the art as a "cot". A top feed roll also often is positioned in engagement with the cot with the roving therebetween to feed the roving from a source of supply to the cutter roll and the cot. With the cutter roll and cot having their axes disposed generally in a common horizontal plane, the chopped fibers are ejected downwardly therefrom, falling through a discharge chute to a distribution chute. The chopped fibers are conveyed by air through the distribution chute and directed along with a spray of resin toward a point of application, such as a surface of a mold or mandrel where the final product is formed. When the glass fibers are uniformly distributed, they are wet-out thoroughly by the resin without any additional mixing upstream of the mold or mandrel being required.

The chopped fibers acquire a static charge below the chopper assembly and have a tendency to agglomerate in the form of hunks or balls in the discharge chute. This can result in non-uniform distribution of the fibers on the product-forming surface beyond the distribution chute and can even cause the discharge or distribution chute to become plugged as well as the cutter wheel. Heretofore, this tendency has been largely overcome by the employment of commercially-available static bars below the chopper assembly. However, the static bars, or more accurately static-remover bars, are hazardous, primarily because of the possibility of arcing in conjunction with fumes from the resin employed in the production process. In addition, fibers tend to hang up on the static bars and the bars require periodic cleaning, which is difficult and time-consuming. It has also sometimes been found necessary to add moisture to the fibers to reduce static.

The present invention provides an improvement in an air system for the production of chopped fibers, which system eliminates the static bars entirely. In accordance with the invention, flow of air is provided past the chopper assembly through the discharge chute toward the distribution chute, along with flow of air through the distribution chute. The downward flow of air past the chopper assembly has been found to eliminate the agglomeration tendency and to provide a more consistent flow pattern for the chopped fibers. This, in turn, results in a better resin-chopped fiber mixture and a stronger product. The hazard resulting from the static bars and the laborious, time-consuming cleaning thereof are likewise eliminated. Further, the addition of moisture to the fibers is unnecessary and it has been found that fibers can be chopped to longer lengths without agglomerating by using the air system in accordance with the invention.

It is, therefore, a principal object of the invention to provide an improvement in the production of chopped fibers.

Another object of the invention is to provide apparatus for producing chopped fibers and distributing same without the use of static bars.

A further object of the invention is to provide an improved air flow system for distributing chopped fibers from a chopper assembly to the point of application.

Yet another object of the invention is to provide a method and apparatus for producing chopped fibers which includes providing a flow of air past the chopper assembly to carry away the chopped fibers therefrom and to supply the fibers uniformly toward a product-forming surface.

Many other objects and advantages of the invention will be apparent from the following detailed description of a preferred embodiment thereof, reference being made to the accompanying drawings, in which.

Figure 1:
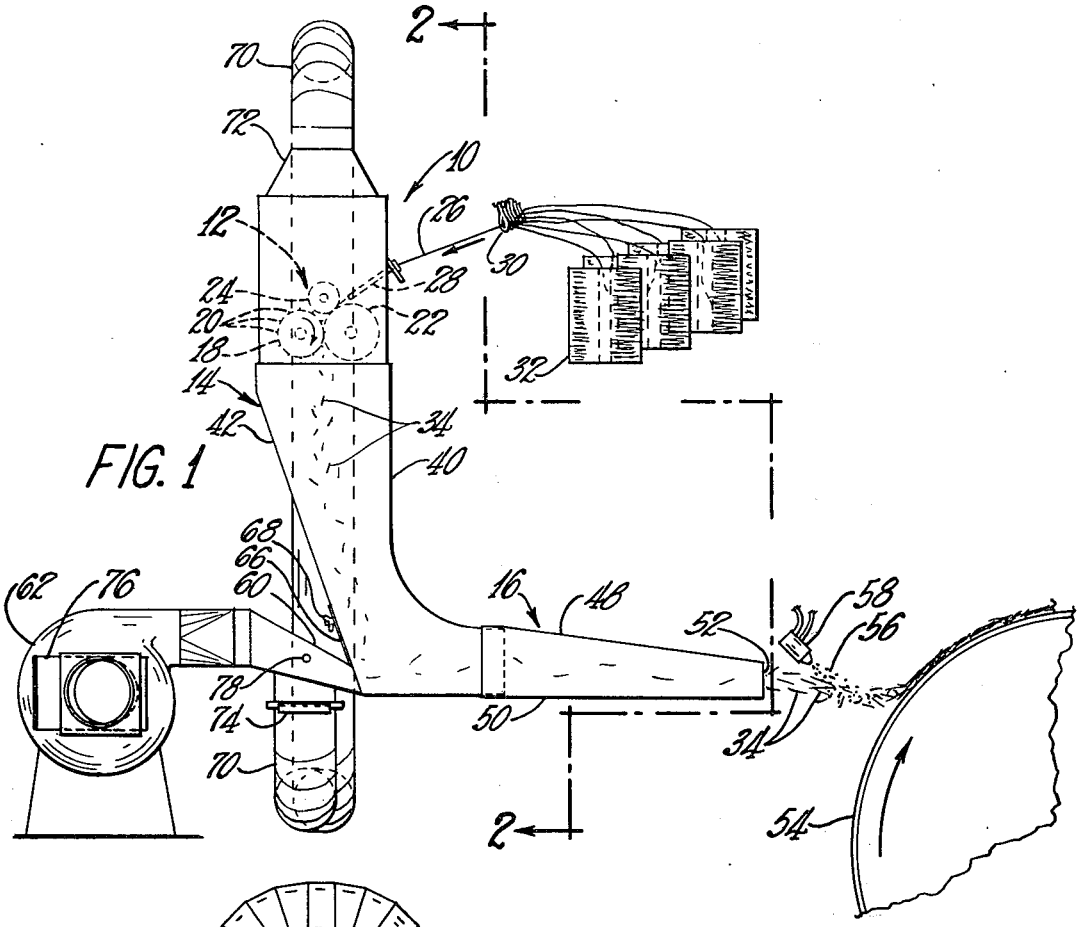
FIG. 1 is a somewhat schematic side view in elevation of apparatus embodying the invention.
Figure 2:
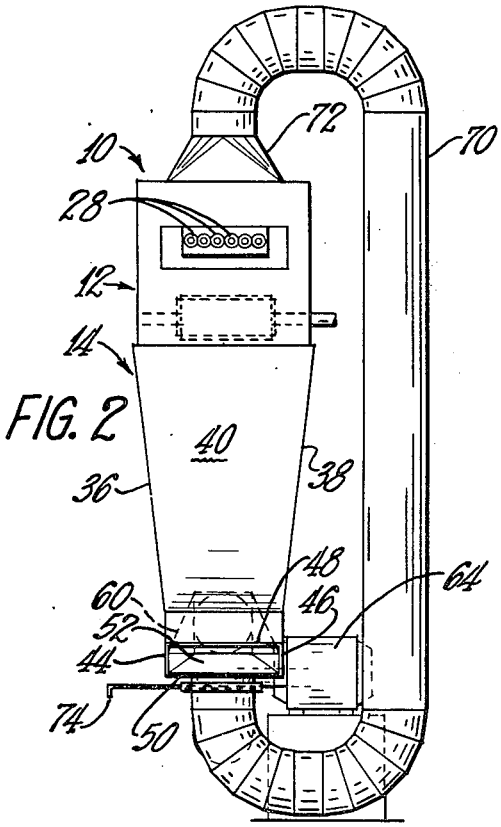
FIG. 2 is a somewhat schematic front view in elevation taken along the line 2—2 of FIG. 1.
Figure 3:
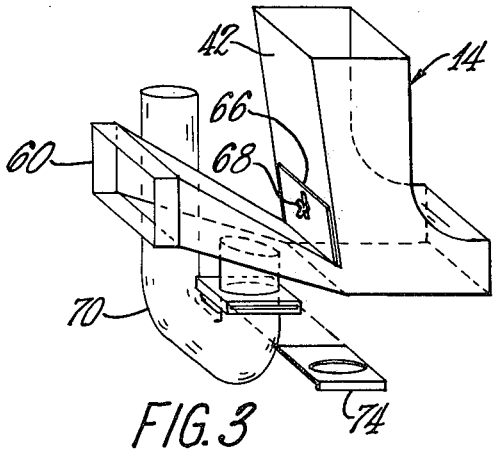
FIG. 3 is a somewhat schematic view in perspective of part of the apparatus of FIGS. 1 and 2.

Referring to the drawings, apparatus for producing chopped fibers is indicated at 10 and basically includes a chopped assembly 12, a discharge duct 14, and a distribution duct 16. The chopper assembly 12 can be of several designs heretofore known for chopping fibers. As shown, the assembly includes a cutter wheel or roll 18 having a plurality of outwardly-extending cutting blades 20 thereon. The blades 20 engage the surface of a back-up roll or cot 22 to chop long fibers supplied thereto into shorter ones. The cot has a soft cylindrical surface produced by a layer of rubber, plastic, or similar material. A top metal feed roll 24 also is in contact with the cot to feed a plurality of rovings 26 therebetween to the cutter roll and cot. As shown, the rovings 26 are fed to a point near the engagement of the cot 22 and feed roll 24 by a plurality of supply tubes 28, there being six such tubes in this instance. The roving 26 for each of the tubes is supplied through a guide eye 30 from a spool or package 32.

Chopped fibers 34 produced by the chopper assembly 12 move downwardly through the discharge chute 14 which is formed by tapered side walls 36 and 38 along with narrowing front and back walls 40 and 42. The chopped fibers 34 then move through the distribution chute 16 which is formed by side walls 44 and 46 and top and bottom walls 48 and 50, terminating in a narrow discharge spout 52. From the discharge spout 52, the chopped fibers 34 can be ejected onto a product-forming surface shown in the form of a mandrel 54, but which also can be a mold, by way of example. Resin 56 is also directed onto the surface 54 by suitable means such as a spray gun 58. If the fibers 34 are uniformly supplied to the surface 54 with the resin 56 also uniformly supplied, proper distribution of the fibers and resin and thorough wet-out can be achieved thereon without any additional mixing or similar operation.

The chopped fibers 34 are conveyed through the distribution chute 16 by a flow of air supplied through a tapering supply duct 60 which directs air into the distribution duct from a suitable blower 62 driven by a motor 64. A plate valve 66 is located at the mouth or discharge end of the supply duct 60 to control the volume of air supplied therethrough. The plate valve 66 is slidably mounted on the rear wall 42 of the discharge duct 14 for adjustable movement, with the plate valve held in a desired position by a wing nut 68.

In accordance with the invention, a downwardly-directed flow of air is supplied past the chopper assembly 12 and through the discharge duct 14. It has been found that the establishment of this air flow eliminates the need for static bars heretofore required below the chopper assembly. Such bars are employed to remove static electricity from the chopped fibers 34 which causes them to agglomerate into clumps or hunks and also to clog the cutter roll 18. The static bars produce a potential safety hazard to the operators and also a fire hazard because of possible ignition of flammable resin fumes in the duct. Fibers also tend to hang up on the static bars requiring periodic cleaning, which is time-consuming and also hazardous. With static bars, moisture often is added to the glass fibers to reduce the static charge on the chopped fibers 34. With the use of the flow of air according to the invention, and the elimination of the static bars, the above disadvantages have been eliminated and, further, longer chopped fibers can be produced and handled than were previously possible.

To produce the downwardly-directed flow of air past the chopper assembly 12, a branch supply duct 70 is employed which communicates with an upper plenum chamber formed by a bonnet 72. The bonnet 72 flares from the discharge end of the branch duct 70 outwardly to a size almost as large as the upper end of the discharge duct 14. With this arrangement, the downward flow of air is directed substantially uniformly over and around the entire chopper assembly 12. The opposite end of the branch duct 70 communicates with the bottom of the supply duct 60 with the flow of air through the branch duct being controlled by a valve plate 74. The valve plate 74 is horizontally disposed and can be slid in and out to control the flow of air from the supply duct 60 and the blower 62 through the branch duct 70. A valve plate 76 is also located at the inlet of the blower or compressor 62 to control the total output thereof. With the valve plates 68, 74 and 76, then, the total air and the relative distribution of air flow through the distribution duct 16 and past the chopper assembly can be readily controlled.

The velocity of the air flowing past the chopper assembly 12 must be sufficient to overcome the cohesive force caused by the static charge which tends to agglomerate the fibers. The tapering of the discharge chute 14 as well as the distribution chute 16 also helps maintain the velocity of the air to keep the fibers apart and in suspension in the air.

While it will be readily understood that the relative distribution of air to the two chutes and the overall volume and velocity will depend on the particular installation, a specific example is hereby set forth, by way of illustration. With the discharge duct 14 being approximately rectangular at its upper portion and ten inches on a side near the chopper assembly, and with the inlet portion of distribution duct 16 having an eight-inch width and a three and one-half inch height, satisfactory operation was achieved with the valve plates adjusted to provide a flow through the discharge duct past the chopper assembly 12 of about 100 cfm and a flow through the distribution duct of about 200–300 cfm. Under these conditions, with a blower output of approximately 400 cfm, satisfactory operation resulted by maintaining a static pressure, as measured in the supply duct 60 at an access opening 78, of from two inches to six inches of water, with four inches of water being preferred. With a pressure above this range, the chopped fibers 34 tend to bounce off of the product-forming surface 54 and with a pressure below this range, the fibers tend not to reach the discharge opening 52 of the distribution duct 16 and to plug it.

Various modifications of the above-described embodiment of the invention will be apparent to those skilled in the art, and it is to be understood that such modifications can be made without departing from the scope of the invention, if they are within the spirit and the tenor of the accompanying claims.

We claim:

1. Apparatus for producing a product comprising a resin and chopped glass fibers, said apparatus comprising a downwardly-extending discharge chute, a chopper assembly positioned in an upper portion of said discharge chute, a distribution chute extending transversely to said discharge chute and communicating with said discharge chute at a lower end thereof, means forming a product-forming surface located near a discharge end of said distribution chute to receive fibers emitted therefrom, means for supplying resin to said surface near the area in which the chopped fibers are received, means for producing a flow of gas through said distribution chute toward the product-forming surface comprising a supply duct communicating with said distribution chute and a source of gas communicating with said supply duct and means for producing a downwardly-directed flow of gas past said chopper assembly and through said discharge chute comprising a branch duct communicating with said supply duct between said source and said distribution chute with the other end of said branch duct positioned to direct the gas downwardly past said chopper assembly.

2. Apparatus according to claim 1 characterized by said discharge chute tapering inwardly at a lower end portion thereof.

3. Apparatus according to claim 1 characterized by means for controlling the flow of gas downwardly past said chopper assembly.

4. Apparatus according to claim 1 characterized by means for controlling the flow of gas through said distribution chute.

5. Apparatus according to claim 1 characterized by means for controlling the output of gas from said source.

* * * * *